US010795318B2

(12) United States Patent
Hasegawa

(10) Patent No.: US 10,795,318 B2
(45) Date of Patent: Oct. 6, 2020

(54) ANALOG DISPLAY DEVICE, ELECTRONIC TIMEPIECE, DISPLAY OPERATION CONTROL METHOD AND STORAGE MEDIUM

(71) Applicant: CASIO COMPUTER CO., LTD., Tokyo (JP)

(72) Inventor: Kosuke Hasegawa, Koganei (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 227 days.

(21) Appl. No.: 15/718,437

(22) Filed: Sep. 28, 2017

(65) Prior Publication Data

US 2018/0120773 A1 May 3, 2018

(30) Foreign Application Priority Data

Nov. 2, 2016 (JP) ..... 2016-215181

(51) Int. Cl.
*G04C 9/00* (2006.01)
*G04C 17/00* (2006.01)
(Continued)

(52) U.S. Cl.
CPC ..... *G04C 9/02* (2013.01); *G04B 19/04* (2013.01); *G04C 17/00* (2013.01); *G04C 11/02* (2013.01); *G04R 60/14* (2013.01)

(58) Field of Classification Search
CPC ..... G04C 9/02; G04C 11/02; G04C 17/00; G04C 9/00; G04C 19/02; G04B 19/04; G04R 60/14
See application file for complete search history.

(56) References Cited

U.S. PATENT DOCUMENTS 9,022,643 B2 * 5/2015 Nagareda ..... G04C 3/14 368/187
9,519,273 B2 * 12/2016 Nishijima ..... G04G 9/00
(Continued)

FOREIGN PATENT DOCUMENTS

CN 103713514 A 4/2014
JP 2006-153651 A 6/2006
(Continued)

OTHER PUBLICATIONS

Extended European Search Report dated Apr. 25, 2018 received in European Patent Application No. 17193562.0.
(Continued)

*Primary Examiner* — Sean Kayes
(74) *Attorney, Agent, or Firm* — Scully Scott Murphy & Presser

(57) ABSTRACT

An analog display device, including: a display; a processor; and an operation member, wherein the display changes a display content by the movable display performing the movement operation, the processor causes the movable display to perform a fast-forward movement operation and display a plurality of display contents in order in accordance with a first input operation, the processor stops the fast-forward movement operation in accordance with a second input operation, and when the processor causes the movable display to perform the fast-forward movement operation, the processor determines a fast-forward movement speed of the movable display in at least a part of switching between display contents which are adjacent to each other in an order of display to a high movement speed which is larger than an average movement speed of the movable display during a round of display of the plurality of display contents.

20 Claims, 8 Drawing Sheets

(51) Int. Cl.

| | |
|---|---|
| ***G04B 19/04*** | (2006.01) |
| *G04R 60/14* | (2013.01) |
| *G04C 11/00* | (2006.01) |

(56) References Cited

U.S. PATENT DOCUMENTS

| | | | | |
|---|---|---|---|---|
| 2014/0092714 | A1 | 4/2014 | Nagareda et al. | |
| 2015/0253740 | A1* | 9/2015 | Nishijima | G04G 9/00 368/80 |
| 2015/0268638 | A1* | 9/2015 | Hasegawa | G04R 20/04 368/47 |
| 2016/0216697 | A1 | 7/2016 | Akiyama | |

FOREIGN PATENT DOCUMENTS

| | | | |
|---|---|---|---|
| JP | 2010-203782 | A | 9/2010 |
| JP | 2014-048148 | A | 3/2014 |
| JP | 2014-070984 | A | 4/2014 |
| JP | 2015-118095 | A | 6/2015 |

OTHER PUBLICATIONS

Notification of Reasons for Refusal dated Sep. 11, 2018 received in Japanese Patent Application No. JP 2016-215181 together with an English language translation.

Indian Office Action dated Nov. 28, 2019 in Indian Patent Application No. 201714034152.

First Office Action dated Sep. 3, 2019 received in Chinese Patent Application No. CN 201711025824.4 together with an English language translation.

* cited by examiner

ANALOG DISPLAY DEVICE, ELECTRONIC TIMEPIECE, DISPLAY OPERATION CONTROL METHOD AND STORAGE MEDIUM

BACKGROUND OF THE INVENTION

1. Field of the Invention

The present invention relates to an analog display device, an electronic timepiece, a display operation control method and a storage medium.

2. Description of Related Art

There has been conventionally an analog display device which rotates hands and a display plate (hereinafter, referred to as hands and such like) by using stepping motors or the like in accordance with electrical signals, and displays information according to the directions indicated by the hands and such like and positional relationships with marks and such like. Such an analog display device is used for display of a set value based on user's operation and switching display of function type in a multi-functional display device in addition to a case where the operation of the analog display device is controlled according to various types of measurable physical quantity such as date and time, elapsed time, temperature, air pressure, electric current and voltage.

As for such an analog display device, Japanese Patent Application Laid Open Publication No. 2010-203782 which is a Japanese patent document discloses a technique of providing a display plate with many marks so as to be parallel to a dial plate, and rotating the display plate to visibly expose only a predetermined number of marks from an opening of the dial plate, for example. Japanese Patent Application Laid Open Publication No. 2006-153651 which is a Japanese patent document discloses a technique of providing both of marks indicating dates and marks indicating reception frequencies of standard radio waves on such a display plate and enabling selectively indicating a plurality of display contents by the single display plate. Since unnecessary information on the display plate is hidden and the portion other than the opening of the dial plate can be effectively used for another use by the above techniques, it is possible to broaden the choices of functions and designs which can be expressed in a limited area.

However, in such an analog display device, the highest rotation speed and the rotation angle are determined according to the torques for rotating the hands and such like and the capacities of stepping motors. Thus, there are some cases where switching of display requires time and makes the user wait for the switching since the rotation angle per step is determined to be small for a hand requiring a large force of the rotation operation, especially, for a circular rotation plate. On the other hand, when the rotation speed is large, in a case of switching display according to user's operation, the user cannot easily stop the hands and such like at appropriate positions and cannot easily visually confirm the indicated positions by the hands and such like or the marks, thus losing convenience for the user.

SUMMARY OF THE INVENTION

There are disclosed an analog display device, an electronic timepiece, a display operation control method and a storage medium.

According to a preferred embodiment of the present invention, there is provided an analog display device, including: a display which includes a movable display; a processor which controls a movement operation of the movable display; and an operation member which receives an input operation by a user, wherein the display changes a display content by the movable display performing the movement operation, the processor causes the movable display to perform a fast-forward movement operation and display a plurality of display contents by the display in order in accordance with a first input operation which is received by the operation member, the processor stops the fast-forward movement operation in accordance with a second input operation which is received by the operation member, and when the processor causes the movable display to perform the fast-forward movement operation, the processor determines a fast-forward movement speed of the movable display in at least a part of switching between display contents which are adjacent to each other in an order of display to a high movement speed which is larger than an average movement speed of the movable display during a round of display of the plurality of display contents by the fast-forward movement operation.

BRIEF DESCRIPTION OF THE DRAWINGS

The above and other objects, advantages and features of the present invention will become more fully understood from the detailed description given hereinafter and the appended drawings which are given by way of illustration only, and thus are not intended as a definition of the limits of the present invention, and wherein.

DETAILED DESCRIPTION OF THE PREFERRED EMBODIMENT

Figure 1:
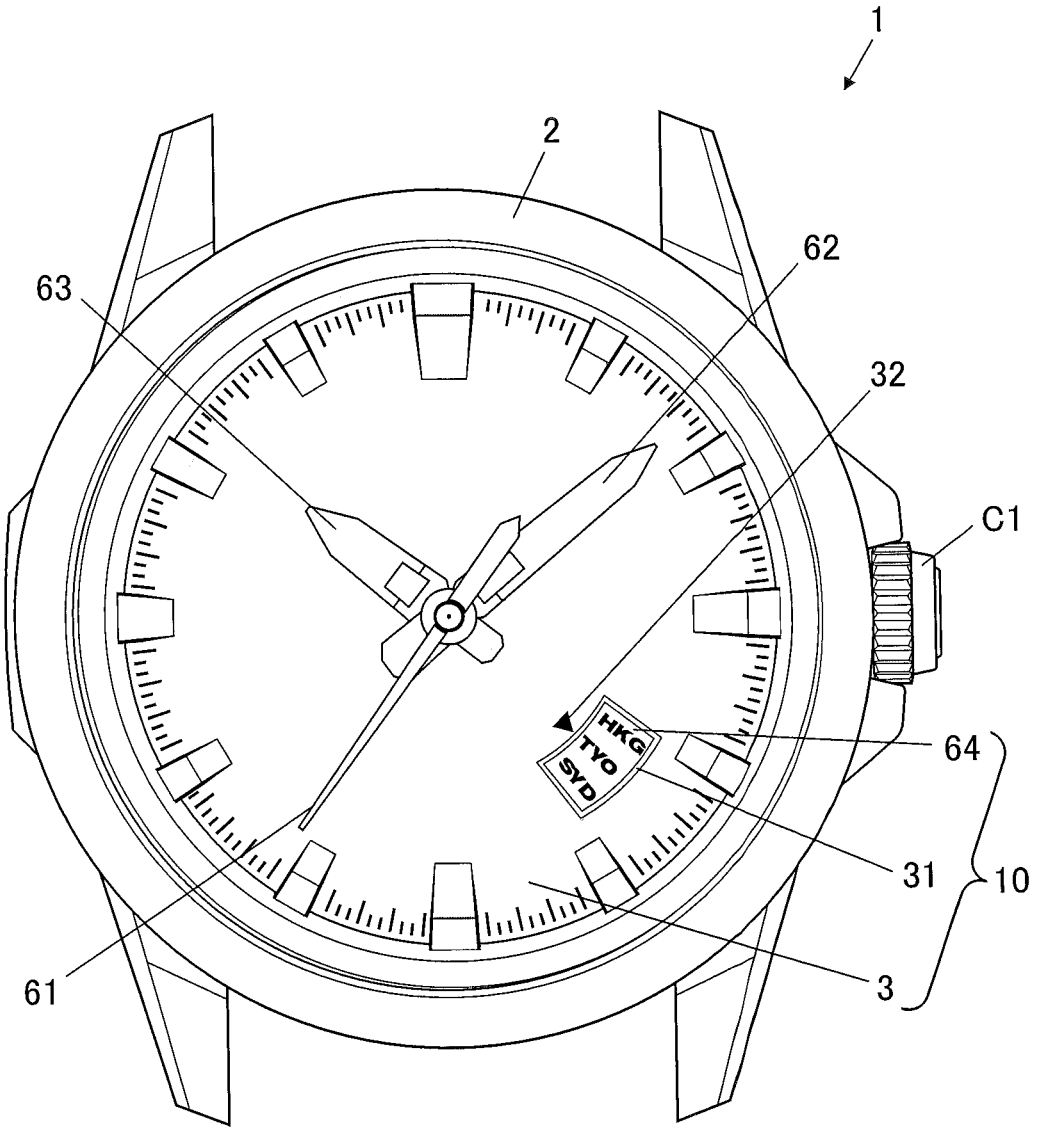
FIG. 1 is a front view showing an electronic timepiece in an embodiment.

FIG. 1 is a front view of an analog electronic timepiece 1 in an embodiment.

The analog electronic timepiece 1 (electronic timepiece) includes: a casing 2 which contains components therein; a dial plate 3 which has one surface (exposed surface) exposed outside in the casing 2; a transparent member (windshield glass) (not shown in the drawings) which covers the exposed surface of the dial plate 3; three time hands 61 to 63 which perform rotation operations over the nearly entire surface of the dial plate 3 around the nearly center of the dial plate 3 as the rotation axis between the dial plate 3 and the windshield glass, and which point to marks and scales provided around the peripheral portion of the dial plate 3; a rotation plate 64 (movable display, display plate) which is provided in the opposite side to the exposed surface of the dial plate 3 so as to be parallel to the dial plate 3 and expose a predetermined number of (here, three) marks from an opening 31 provided in the 4:30 direction of the dial plate 3 according to a rotation operation (movement operation); a crown C1 which is provided on a lateral side with respect to the exposed surface of the dial plate 3 in the casing 2; and such like.

The dial plate 3 is circularly provided with scales and marks (time marks) indicating hours, minutes and seconds. The dial plate 3 forms a shielding plate which is provided so as to cover one surface of the rotation plate 64 over the range other than the portion exposed from the opening 31.

The time hands 61 to 63 are a second hand 61, a minute hand 62 and an hour hand 63, and normally indicate the hour, the minute and the second of time respectively when displaying the time.

Figure 2:
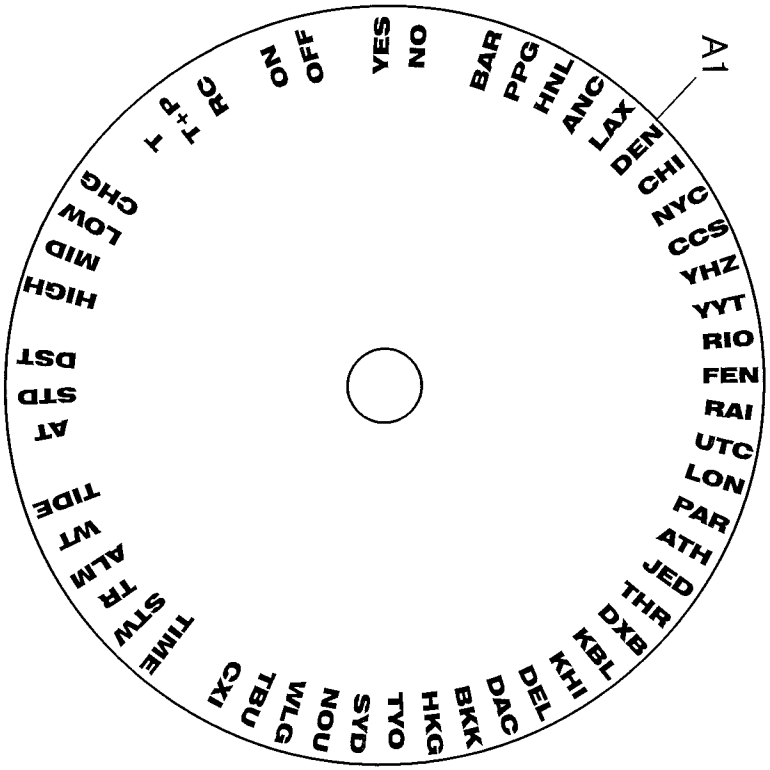
FIG. 2 is a front view of a rotation plate.

FIG. 2 is a front view of the rotation plate 64.

A plurality of (here, 54) marks is circularly provided at predetermined angle intervals, for example, at 6 degrees intervals (all the intervals are not necessarily equal, and here, the intervals are partially 12 degrees intervals) on a peripheral portion of the rotation plate 64. Among the marks, each of 33 marks from the mark "BAR" to the mark "CXI" (predetermined rotation angle range) indicates a name of a region (city) representing a time zone (including UTC=Universal Time Coordinated) in the world, the mark "BAR" being provided in the 330 degrees direction by the right-hand rotation (clockwise rotation) (the same applies hereinafter) with respect to the rotation shaft from the direction (which can be set arbitrarily) of the reference mark A1, and the mark "CXI" being provided in the 162 degrees direction. The marks from the mark "TIME" provided in the 174 degrees direction to the mark "TIDE" provided in the 204 degrees direction indicate various function types which can be executed by the analog electronic timepiece 1. The marks from the mark "AT" provided in the 216 degrees direction to the mark "DST" provided in the 228 degrees direction indicate the types of setting regarding whether to implement summer time. The marks from the mark "HIGH" provided in the 240 degrees direction to the mark "CHG" provided in the 258 degrees direction indicate the remaining amounts of battery. The marks from the mark "T" provided in the 270 degrees direction to the mark "RC" provided in the 282 degrees direction indicate acquisition states of date and time and current position information by reception of radio waves and standard radio waves from positioning satellites. The mark "ON" provided in the 294 degrees direction and the mark "OFF" provided in the 300 degrees direction indicate whether an alarm notification function is set. The mark "YES" provided in the 312 degrees direction and the mark "NO" provided in the 318 degrees direction indicate whether the radio waves or standard radio waves were received from the positioning satellites.

All of the above-mentioned marks can be selectively exposed from the opening 31 in accordance with rotation of the rotation plate 64. Here, among the marks, three marks (a part of marks) which are adjacent in the arrangement order at 6 degrees intervals are exposed. The dial plate 3 is provided with an indication mark 32 in the 4:30 direction, which is in the 135 degrees direction with respect to the 12:00 direction so as to point to the middle mark among the marks which are three at maximum and exposed from the opening 31. The 4:30 direction is a display position of a mark, and the mark at the display position is indicated as a display content to the user.

Hereinafter, the time hands 61 to 63 and the rotation plate 64 are also referred to as hands 61 to 64 when they are collectively indicated.

The dial plate 3 including the opening 31 and the rotation plate 64 form a display 10. The display 10 can include the time hands 61 to 63.

The crown C1 receives an input operation from a user. The crown C1 can be pulled out from the casing 2 in two stages, outputs an operation signal to the CPU 41 (see FIG. 3) by being rotated by a predetermined unit angle in a state in which the crown C1 is pulled out by one stage or two stages, and thus used for various types of setting.

Figure 3:
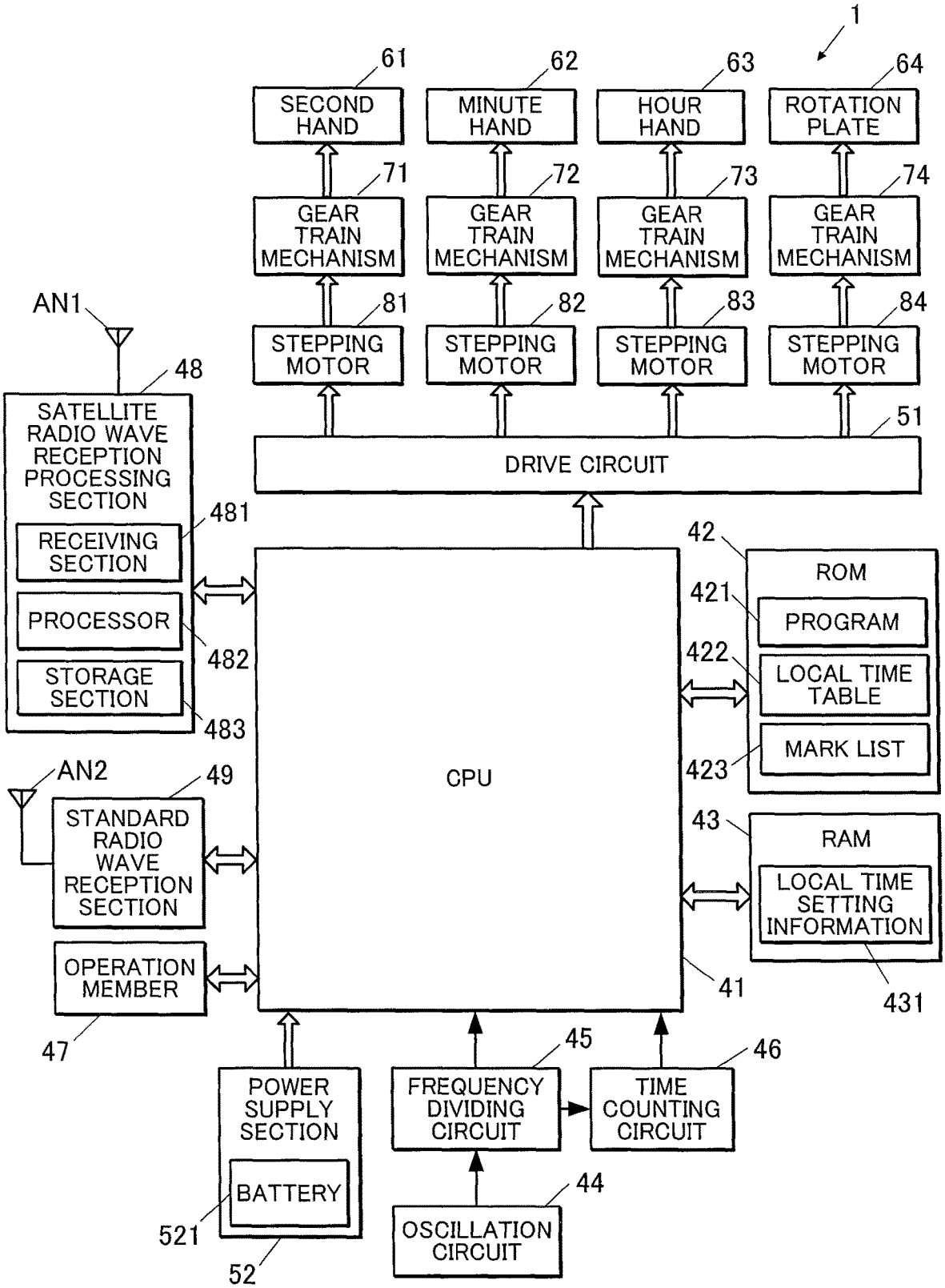
FIG. 3 is a block diagram showing a functional configuration of the electronic timepiece.

FIG. 3 is a block diagram showing a functional configuration of the analog electronic timepiece 1.

The analog electronic timepiece 1 includes the CPU 41 (Central Processing Unit) (processor), a ROM 42 (Read Only Memory), a RAM 43 (Random Access Memory), an oscillation circuit 44, a frequency dividing circuit 45, a time counting circuit 46 (time counter), an operation member 47, a satellite radio wave reception processing section 48, an antenna AN1 thereof, a standard radio wave reception section 49, an antenna AN2 thereof, a drive circuit 51, a power supply section 52, the above-mentioned time hands 61 to 63 and rotation plate 64, gear train mechanisms 71 to 74, stepping motors 81 to 84 and such like.

The CPU 41 is a processor which performs various types of arithmetic processing and integrally controls the entire operation of the analog electronic timepiece 1. The CPU 41 controls hand operations for display of date and time. The CPU 41 converts the date and time counted by the time counting circuit 46 into appropriate local time on the basis of local time setting information including the time zone which is set and the implementation information of summer time, and controls the time hands 61 to 63 to display the converted local time in an execution mode of a normal time display function.

The CPU 41 operates the satellite radio wave reception processing section 48 and the standard radio wave reception section 49 to obtain date and time information and obtain the current position on the basis of the operation of the satellite radio wave reception processing section 48. The CPU 41 corrects the date and time counted by the time counting circuit 46 on the basis of the obtained date and time data. The CPU 41 can also change the local time setting information on the basis of the current position data.

The ROM 42 stores a program 421 and setting data for various controls executed by the CPU 41. The program 421 includes a program for operation control of various function modes, for example. The setting data includes a local time table 422 which is a table storing each city name which is selectable at the time of local time setting, the position (mark position) on the rotation plate 64 where the mark indicating the city is provided, the time zone (time difference from the UTC time) in the city and the summer time implementation rule (implementation period and time shift amount during the implementation period) so as to be associated with each other. The ROM 42 also stores a mark list 423 associating the position of each mark on the rotation plate 64, the contents and the function type which can be indicated by pointing to the position. In a case where the range of providing a plurality of (predetermined number which is two or more) marks corresponding to each function type (rotation angle range) is limited uniquely (that is, ranges are different from each other) and the marks are arranged at equal intervals in the ranges, only the association between each function type and the range may be separately stored.

The RAM 43 provides a working memory space to the CPU 41, and temporary data is stored in the RAM 43. In the RAM 43, history regarding acquisition of date and time information and position information, local time setting information 431 which is currently selected and set, data indicating hand positions and such like are stored.

The oscillation circuit 44 generates and outputs a predetermined frequency signal. The oscillation circuit 44 includes a crystal oscillator, for example.

The frequency dividing circuit 45 divides a frequency signal output from the oscillation circuit 44 into frequency signals used by the CPU 41 and the time counting circuit 46, and outputs the divided signals. The output frequency may be set to be changeable by a control signal from the CPU 41.

The time counting circuit 46 counts the current date and time by counting the divided frequency signals input from the frequency dividing circuit 45 and adding the counted value to an initial value indicating predetermined date and time. The date and time counted by the time counting circuit 46 has an error (rate) which is, for example, approximately 0.5 seconds per day according to accuracy of the oscillation circuit 44. The date and time counted by the time counting circuit 46 can be corrected by a control signal from the CPU 41.

The operation member 47 receives an input operation from a user. The operation member 47 includes the above-mentioned crown C1. When the crown C1 is pulled out, pushed back or rotated, an electrical signal according to the type of the operation is output to the CPU 41. The crown C1 can be pulled out in two stages, and receives the operation of contents corresponding to the pulled state. The operation member 47 may include other one or a plurality of push button switches, touch panel or the like.

The satellite radio wave reception processing section 48 receives radio waves from positioning satellites including at least a positioning satellite (GPS satellite) according to GPS (Global Positioning System) by using the antenna AN1, and decodes or deciphers the signals (navigation message data) through demodulation of the transmitted radio waves with a spread spectrum from the positioning satellites. The satellite radio wave reception processing section 48 includes a receiving section 481, a processor 482 and a storage section 483. The code string of the navigation message which was received by the receiving section 481 and demodulated is deciphered by the processor 482, and further various types of arithmetic processing are performed as needed to obtain the date and time information, the current position information and such like. The processor 482 outputs data in response to the request from the CPU 41 to the CPU 41 in a format which was set in advance.

As the storage section 483, there is used a non-volatile memory such as a flash memory or an electrically erasable and programmable read only memory (EEPROM). The stored contents are held regardless of a power supply state to the satellite radio wave reception processing section 48. The storage section 483 can store various programs for operation control, information on the predicted orbit of each positioning satellite obtained from the positioning satellite, and setting data such as correction values for leap seconds.

The storage section 483 can store leap second correction data necessary for acquisition of date and time, position prediction information (orbit information) of each positioning satellite and such like.

The components in the satellite radio wave reception processing section 48 are collectively provided as a single module on a chip and connected to the CPU 41. The CPU 41 controls on and off of the operation of the satellite radio wave reception processing section 48 independently from the operations of the other components of the analog electronic timepiece 1. When the operation of the satellite radio wave reception processing section 48 is not required, the analog electronic timepiece 1 cuts off the power supply to the satellite radio wave reception processing section 48 to save the electrical power.

The standard radio wave reception section 49 receives standard radio waves containing date and time information, here the radio waves transmitted in a low frequency band, via the antenna AN2, demodulates and identifies a code string (time code signal) and outputs the data as a binarized digital signal to the CPU 41. By control of the CPU 41 of the reception target, the standard radio wave reception section 49 changes the tuning frequency according to the transmission frequency of each of the standard radio waves to receive the standard radio waves. The standard radio wave reception section 49 may include various processing circuits and such like for reducing or removing the influence of noise in identification of each code.

The CPU 41 can control the on and off of the operation of standard radio wave reception section 49 independently from the operations of the other sections in the analog electronic timepiece 1.

The power supply section 52 supplies electric power according to operations of sections at a predetermined voltage from a battery 521. A solar panel and a secondary battery are used as the battery, for example. A button type dry cell which is detachable to be replaced may also be used as the battery. In a case where the power supply section 52 outputs a plurality of different voltages, the power supply section 52 may include a switching power supply or the like, for example, to enable conversion into a desired voltage to allow the output.

The stepping motor 81 causes the second hand 61 to perform a rotation operation via the gear train mechanism 71 which has a plurality of arranged gears. When the stepping motor 81 is driven once, the second hand 61 is rotated by 6 degrees as one step. When the stepping motor 81 is driven 60 times, the second hand 61 makes one rotation on the dial plate 3.

The stepping motor 82 causes the minute hand 62 to perform a rotation operation via the gear train mechanism 72. When the stepping motor 82 is driven once, the minute hand 62 is rotated by 1 degree as one step. When the stepping motor 82 is driven 360 times, the minute hand 62 makes one rotation on the dial plate 3.

The stepping motor 83 causes the hour hand 63 to perform a rotation operation via the gear train mechanism 73. When the stepping motor 83 is driven once, the hour hand 63 is rotated by 1 degree as one step. When the stepping motor 83 is driven 360 times, the hour hand 63 makes one rotation on the dial plate 3.

The stepping motor 84 causes the rotation plate 64 to perform a rotation operation via the gear train mechanism 74. When the stepping motor 84 is driven once, the rotation plate 64 is rotated by 0.15 degrees as one step. That is, the rotation plate 64 is rotated by 6 degrees by 40 steps of rotation, moves for the amount of a single mark (that is, 6 degrees) which is arranged at a 6 degree interval, and makes one rotation below the dial plate 3 by 2400 steps of rotation.

Though the hands 61 to 64 are not especially limited, each of the hands 61 to 64 can rotate at 400 pps (pulse per second) (highest speed) at fastest in a forward direction (direction in which time advances, clockwise direction, right-hand rotation) and in a backward direction (direction in which time goes back, counterclockwise direction, left-hand rotation). The analog electronic timepiece 1 can also control the rotation at a plurality of fast-forward speeds (fast-forward movement speeds) which are 200 pps, 128 pps, 64 pps and 32 pps, for example. In order to rotate all of the time hands 61 to 63 and the rotation plate 64 at 400 pps, the stepping motor 84 may have a higher capacity than the stepping motors 81 to 83. The apparent rotation speed of the rotation plate 64 is determined by a product of the operation speed (pps) of the stepping motor by the magnitude of the rotation angle per step (rotation angle by input of 1 pulse) of the rotation plate 64. Here, the rotation speed indicates the magnitude (absolute value) of the speed unless otherwise stated, and the rotation direction is determined separately.

The drive circuit 51 outputs drive pulses of predetermined voltages to the stepping motors 81 to 84 in accordance with the control signals from the CPU 41, and causes the rotors of the stepping motors 81 to 84 to perform rotation operations by a predetermined angle (for example, 180 degrees) with respect to the stators. The drive circuit 51 can vary the length of the drive pulses (pulse width) according to the condition of the analog electronic timepiece 1 and such like. If control signals for simultaneously driving a plurality of hands are input, the drive circuit 51 can slightly shift the output timings of the drive pulses so as to reduce the load.

Among the components, the CPU 41, the ROM 42, the RAM 43, the oscillation circuit 44, the frequency dividing circuit 45 and the time counting circuit 46 can be integrally formed as a microcomputer (computer) on a chip. Or the ROM 42, the oscillator of the oscillation circuit 44 and such like may be externally provided with respect to the microcomputer.

Next, the rotation operation of the rotation plate 64 in the analog electronic timepiece 1 in the embodiment will be described.

In the analog electronic timepiece 1, there are a case where the CPU 41 determines the end point and automatically stops the rotation of the rotation plate 64 (that is, performs switching operation of display between two display contents which were set in advance) and a case where the rotation of the rotation plate 64 is stopped at an arbitrary position in accordance with a stop instruction obtained according to the input operation to the operation member 47 (including a case where the stoppable position is limited). In the former case, the CPU 41 can move the rotation plate 64 to a desired position rapidly by determining the rotation direction of the rotation plate 64, calculating the movement amount and thereafter causing the rotation plate 64 to perform the rotation operation at a highest speed which can be set (set movement speed).

On the other hand, in a case of stopping the rotation operation of the rotation plate 64 on the basis of the input operation to the operation member 47, the user performs the operation of stopping the rotation at a desired position while visually confirming the rotation position of the rotation plate 64 (for example, angle direction of the reference mark A1 with respect to the 12 o'clock direction of the dial plate 3), that is, the marks exposed from the opening 31. At this time, since only the three marks among the plurality of marks on the rotation plate 64 are exposed from the opening 31, the user cannot necessarily estimate in advance the number of remaining steps for rotation in order to move the desired mark which is hidden on the dial plate 3 to the display position and stop the rotation. In a case of continuous fast-forwarding of the rotation plate 64, each of the marks is exposed from the opening 31 for a shorter time as the fast-forward speed is faster, and by a time lag from when the user notices the exposure of the desired mark to when the stop operation is performed and the rotation is actually stopped, the desired mark largely passes over the display position, and furthermore, the user cannot visually confirm the exposure of the desired mark. On the other hand, if the rotation speed of the rotation plate 64 is uniformly lowered, the time required for mark switching is increased.

In the analog electronic timepiece 1 in the embodiment, in a case of switching the mark to be exposed from the opening 31 and located at the display position on the basis of user's operation, the mark to be exposed is changed by one mark according to the rotation direction of the crown C1 among the plurality of marks (a plurality of display contents) of the display target corresponding to the function type by the user pulling the crown C1 in one stage or two stages and rotating the crown C1 by a predetermined unit angle according to the function type related to the mark switching. In the analog electronic timepiece 1, when the rotation (first input operation) by a unit angle of the crown C1 is detected a predetermined number of (two or more) times within a predetermined period, the rotation plate 64 is continuously fast-forwarded (first stage of fast-forwarding). When the rotation by the unit angle of the crown C1 is further detected in the same direction in the above fast-forwarding state, the fast-forwarding is shifted to the second stage fast-forwarding. The difference between the first stage fast-forwarding and the second stage fast-forwarding will be described later. In a state of the first or second stage fast-forwarding, when the rotation of crown C1 by the unit angle in the opposite direction to the above rotation by the unit angle (second input operation) is detected, control is made to stop the fast-forwarding.

In these switching operations of marks, the rotation plate 64 is rotated at a high speed (high movement speed), that is, at 400 pps when the mark is switched for the amount of a single mark. On the other hand, in a case of continuously fast-forwarding the rotation plate 64, the rotation speed (fast-forward movement speed) is slightly lower than the speed of the high-speed rotation. Since the marks not related to the function type which is currently executed are also mixed on the rotation plate 64, when the marks not related to the function type pass the display position (including a state in which a display content which is not the target of display is displayed), the rotation speed is not lowered and the rotation is performed at the high speed. That is, in the continuous fast-forwarding, the high-speed rotation part and the rotation part at a lower rotation speed are mixed, and the average rotation speed (average movement speed) during a round of display of the marks which are the display target is smaller than the rotation speed of the high-speed rotation and larger than the rotation speed for the part of rotation at the lowered rotation speed.

Figure 4A:
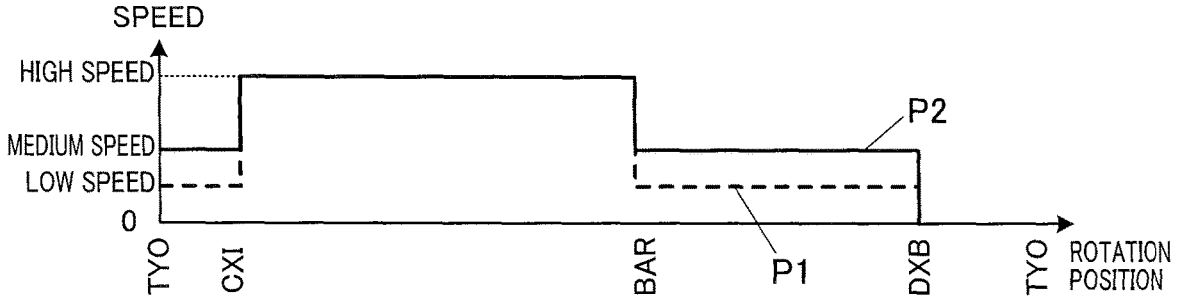
FIG. 4A is a view showing a setting example of a rotation speed of the rotation plate.

FIG. 4A is a view showing a setting example of the rotation speed of the rotation plate 64 in the analog electronic timepiece 1 in the embodiment.

As shown in FIG. 4A, for example, in a case of changing the set city from Tokyo (TYO) to Dubai (DXB) in an execution mode of the world clock function (WT), the rotation plate 64 shown in FIG. 2 is rotated by fast-forwarding at an initial low speed (P1) or at a medium speed (P2) larger than the low speed until the mark position of Christmas Island (CXI) which is one end of the arrangement range of city marks on the rotation plate 64 reaches the display position. From the mark position of the Christmas Island to the mark position of Baker (BAR) which is the next city mark (that is, the other end of the arrangement range of the city mark), there is an angle difference larger than the angle difference (6 degrees) for the amount of a single mark, and the marks which are not related to the city setting are arranged. The rotation for the above range is performed at a high speed higher than any speed regardless of the fast-forwarding stage (P1, P2). When the mark position of Baker reaches the display position or at a timing which is a predetermined number of steps (for example, 20 steps) before the reaching, the rotation speed of the rotation plate 64 is returned to the low speed (P1) or the medium speed (P2) again. By the user inputting the stop operation of the fast-forward rotation operation at a timing when the mark of Dubai (DXB) reaches the display position or immediately before the timing (that is, after the mark position of Teheran (THR) located right before the Dubai (DXB) passes the display position), the fast-forwarding is stopped at the timing when the mark of Dubai reaches the display position.

As for the actual speeds of the low speed, medium speed and high speed which are set here, the low speed and the medium speed are determined to be an upper limit speed or less allowing the user to visibly confirm the exposed marks effortlessly, whereas, at the high speed, the user does not need to visibly confirm the exposed marks and the time required for movement can be shortened by determining the high speed to the highest speed (400 pps) which can be set according to the stepping motor 84, the rotation plate 64 and such like.

Figure 5:
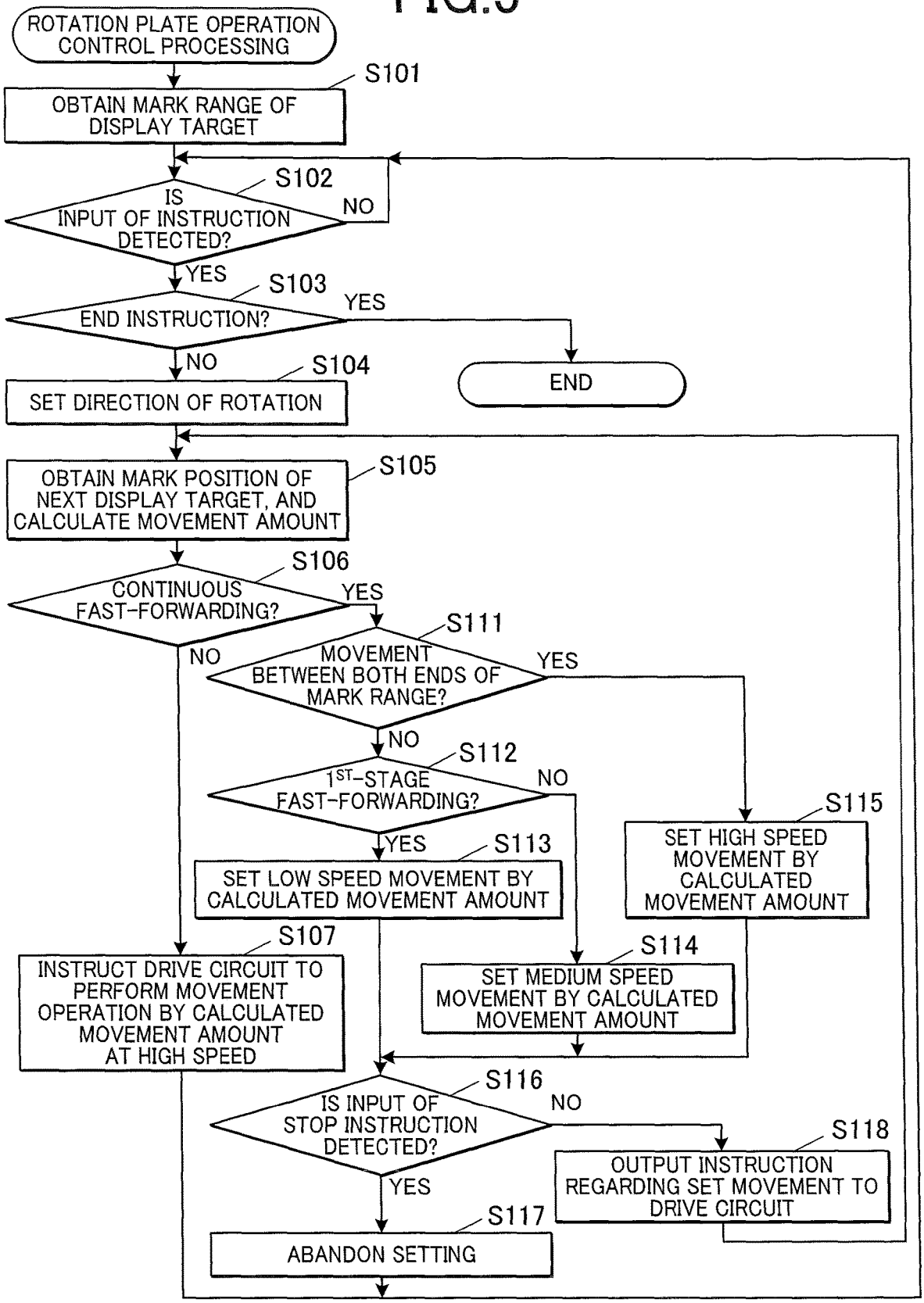
FIG. 5 is a flowchart showing a control procedure of rotation plate operation control processing.

FIG. 5 is a flowchart showing the control procedure by the CPU 41 of rotation plate operation control processing to be executed in the analog electronic timepiece 1 in the embodiment.

The rotation plate operation control processing is started when the pulling operation of the crown C1 is detected and the processing is shifted to various setting operations by the rotation of the rotation plate 64.

When the rotation plate operation control processing is started, the CPU 41 obtains information regarding the range where the marks which can be a display target are arranged (step S101). The CPU 41 refers to the mark list 423, and reads the arrangement range of the marks corresponding to the function type which is currently operated.

The CPU 41 determines whether input of an instruction corresponding to rotation, pulling or pushing operation of the crown C1 is detected (step S102). If it is not determined that the input is detected (step S102: NO), the CPU 41 repeats the processing of step S102. If it is determined that the input is detected (step S102: YES), the CPU 41 determines whether the detected instruction is an end instruction of various setting operations (step S103). If it is determined that the detected instruction is the end instruction (step S103: YES), the CPU 41 ends the rotation plate operation control processing.

If it is not determined that the detected instruction is the end instruction (step S103: NO), the CPU 41 sets the rotation direction of the rotation plate 64 according to the rotation direction of the crown C1 (step S104). The CPU 41 obtains the position of the mark which is the next display target in the rotation direction and calculates the movement amount for moving the mark to the display position (step S105).

The CPU 41 determines whether the obtained instruction is an instruction of continuous fast-forwarding (step S106). The continuous fast-forwarding here indicates fast-forwarding operation which is continued until the user performs the stop operation without setting, in advance, to end the fast-forwarding at a timing of moving a specific mark to the display position. The continuous fast-forwarding includes a case where the rotation speed of the rotation plate 64 is temporarily zero (rotation is temporarily stopped). If it is not determined that the obtained instruction is the instruction of continuous fast-forwarding (step S106: NO), the CPU 41 outputs an instruction to cause the drive circuit 51 to rotate the rotation plate 64 by the calculated movement amount at a possible highest speed, that is, the highest speed which can be set (step S107). Then, the processing of the CPU 41 returns to step S102.

If it is determined that the detected instruction is the instruction of continuous fast-forwarding (step S106: YES), the CPU 41 determines whether the rotation of the rotation plate 64 by switching from the mark before movement to match the display position to the mark of the movement destination is movement (rotation between mark positions of the both ends) between the both ends of the mark range obtained in step S101 (step S111). If it is determined that the rotation is the movement between the both ends (step S111: YES), the CPU 41 sets to perform the movement between the both ends, that is, movement by the calculated movement amount at the above-mentioned highest speed (step S115). Then, the processing of the CPU 41 shifts to step S116.

If it is not determined that the rotation is the movement between the both ends of the mark range (step S111: NO), the CPU 41 determines whether the rotation is the first stage fast-forwarding operation (step S112). If it is determined that the rotation is the first stage fast-forwarding operation (step S112: YES), the CPU 41 sets the movement speed for the calculated movement amount to the low speed (step S113). The low speed here is the speed which is smaller than the above-mentioned highest speed and allows the user to sufficiently visibly confirm the marks in the opening 31. Then, the processing of the CPU 41 shifts to step S116.

If it is determined that the rotation is not the first stage fast-forwarding operation, that is, the rotation is the second stage fast-forwarding operation (step S112: NO), the CPU 41 sets the movement speed for the calculated movement amount to the medium speed (step S114). The medium speed here is the speed in a range faster than the above-mentioned low speed and slower than the highest speed and in a range allowing a general user to visibly confirm the marks in the opening 31. The processing of the CPU 41 shifts to step S116.

If the processing is shifted from any one of steps S113 to S115 to step S116, the CPU 41 determines whether input of the stop instruction of the fast-forwarding is detected from the output of the instruction regarding fast-forwarding to the drive circuit 51 in the processing of previous step S118 (step S116). If it is determined that the input is detected (step S116: YES), the CPU 41 abandons the setting which was performed in the processing of any one of steps S113 to S115 (step S117), and returns the processing to step S102. Thus, the rotation plate 64 is stopped at the stage of completion of the execution of the instruction of fast-forwarding which was output in the previous step S118 (in a case of before starting the fast-forwarding, execution of the movement operation instruction which was output in step S107).

If it is not determined that input of the stop instruction of fast-forwarding is detected (step S116: NO), the CPU 41 outputs the instruction of the fast-forwarding operation corresponding to the setting which was made in the processing of any one of steps S113 to S115 to the drive circuit 51 (step S118). In a case where the continuous fast-forwarding of the rotation plate 64 has been already started at the time of the above output, the fast-forwarding is continuously performed following (with change of speed in a case of changing the movement speed) the fast-forwarding by the calculated movement amount which was output in the processing of previous step S118. Then, the processing of the CPU 41 returns to step S105.

Modification Example 1

Figure 6:
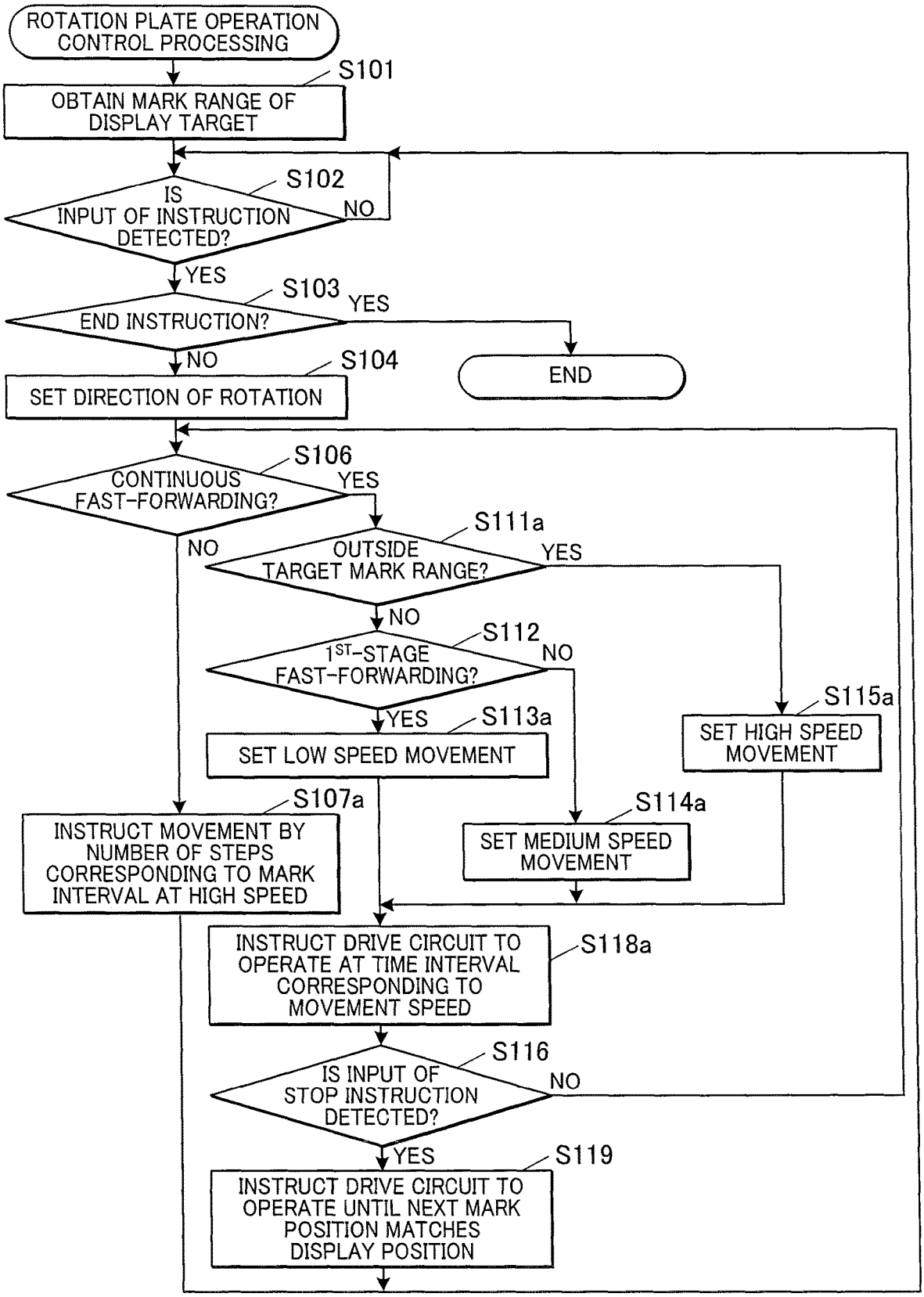
FIG. 6 is a flowchart showing a modification example 1 of the rotation plate operation control processing.

FIG. 6 is a flowchart showing a modification example 1 of rotation plate operation control processing in the analog electronic timepiece 1 in the embodiment.

In the modification example 1, though the apparent rotation operation of the rotation plate 64 is same as the rotation in the above embodiment, the contents of the operation control are different from those of the above embodiment. Here, it is set and stored in advance that the interval between marks on the rotation plate 64 is 6 degrees and 40 steps. The number of movement steps between the marks at the both ends in the mark range is obtained or calculated when the mark range is obtained in the processing of step S101.

In the rotation plate operation control processing of the modification example 1, the processing of steps S105 and S117 in the rotation plate operation control processing of the embodiment is omitted, and the processing of step S119 is added. The processing of steps S107, S111, S113 to S115 and S118 is changed to the processing of steps S107*a*, S111*a*, S113*a* to S115*a* and S118*a*, respectively, and the position of the processing of step S116 is changed. The other processing is same as the processing of the embodiment, and same reference numerals are used for same processing contents to omit detailed explanation.

When the processing of step S104 is finished, the processing of the CPU 41 is shifted to step S106. If the processing proceeds to "NO" in the determination processing of step S106, the CPU 41 outputs, to the drive circuit 51, the movement operation instruction of the number of steps (40 steps) corresponding to the mark interval (6 degrees) at the set highest speed (step S107*a*). The processing of the CPU 41 then returns to step S102.

If the processing proceeds to "YES" in the determination processing of step S106, the CPU 41 determines whether the movement to the next step position in the rotation direction is outside the mark range which is the display target (step S111*a*). If it is determined that the movement is outside the mark range (step S111*a*: YES), the CPU 41 sets the movement speed to the high speed (step S115*a*). Then, the processing of the CPU 41 is shifted to step S118*a*.

If it is not determined that the movement to the next step position is outside the mark range (step S111*a*: NO), the CPU 41 determines whether it is the first stage fast-forwarding (step S112). If it is determined that it is the first stage fast-forwarding (step S112: YES), the movement speed is set to the low speed (step S113*a*), and thereafter shifts to the processing to step S118*a*. If it is not determined that it is the first stage fast-forwarding (step S112: NO), the CPU 41 sets the movement speed to the medium speed (step S114*a*), and shifts the processing to step S118*a*.

If the processing is shifted from any of the steps S113*a* to S115*a* to step S118*a*, the CPU 41 outputs an instruction to cause the drive circuit 51 to perform 1-step rotation operation of the rotation plate 64 after the period corresponding to the set movement speed has elapsed from the previous rotation of the rotation plate 64 (step S118*a*). The CPU 41 determines whether input of the stop instruction of the rotation operation is detected (step S116). If it is not determined that the input is detected (step S116: NO), the processing of the CPU 41 returns to step S106. If it is determined that the input is detected (step S116: YES), the CPU 41 outputs the rotation instruction of the rotation plate 64 to the drive circuit 51 at the current set speed (that is, at the time interval) until the mark of the display target, which is to reach the display position next, reaches the display position according to the current rotation position and rotation direction of the rotation plate 64 (step S119). Then, the processing of the CPU 41 returns to step S102.

That is, in the rotation plate operation control processing of the modification example 1, when the rotation plate 64 is fast-forwarded, the movement speed can be changed by performing determination regarding whether the movement is performed for inside or outside the mark range and determination regarding the fast-forwarding stage for each step of rotation.

Modification Example 2

Next, a modification example 2 of the rotation plate operation control processing will be described.

Figure 4B:
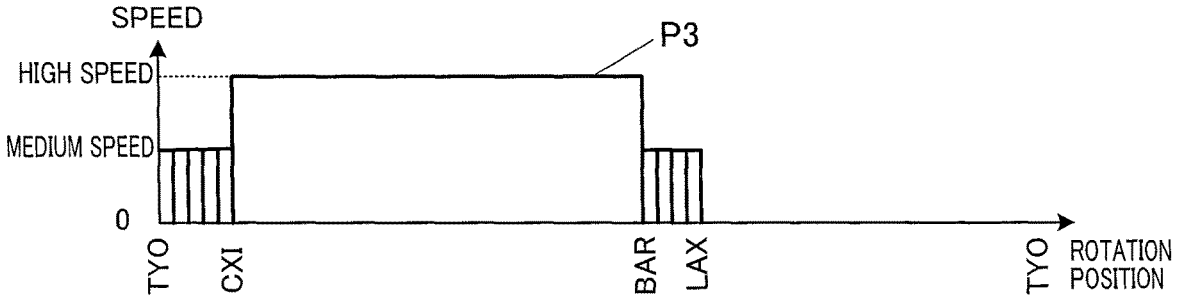
FIG. 4B is a view showing a setting example of a rotation speed of the rotation plate.

In the rotation plate operation control processing of the modification example 2, in a first stage continuous fast-forwarding, as shown in FIG. 4B, the fast-forwarding is stopped (temporarily stopped) for a predetermined period at a timing when each mark of the display target matches the display position. Unless the input operation of the stop instruction received by the operation member 47 is detected, the stop is released after the predetermined period and the fast-forwarding is restarted (that is, the continuous fast-forwarding can include a period (temporal stop period) when the rotation sped is zero, the period being temporarily inserted regardless of the operation input). Contrary to the modification example 1, the distance between marks is not limited to be uniform. Accordingly, the mark range which is the display target may be arranged so as to be divided into a plurality of blocks.

Figure 4C:
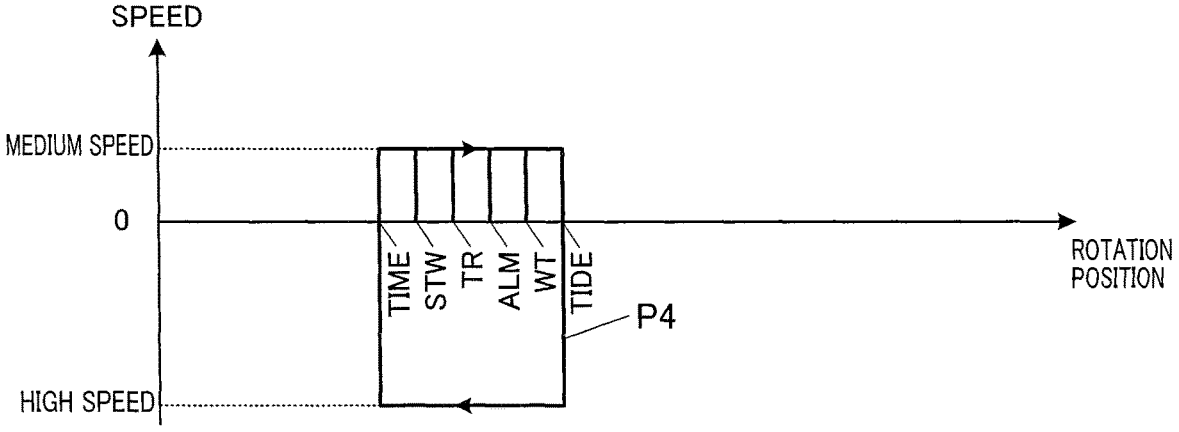
FIG. 4C is a view showing a setting example of a rotation speed of the rotation plate.

In the processing of step S105, in a case of performing the fast-forward movement between marks at both ends of the mark range, it is not necessary to perform rotation in the rotation direction instructed by user's operation (rotation of crown C1). For example, in a case where the distance (angle) between the marks is small, the rotation plate 64 can be rotated in the direction opposite to the instructed direction. As shown in FIG. 4C, in the mode switching of function operation, since there are six marks indicating the mode type and the arrangement range is 30 degrees, when fast-forward movement is performed from a state in which the mark at one end of the arrangement range is located at the display position to a state in which the mark at the other end is located at the display position, the fast-forwarding direction of the rotation plate 64 is reversed and the rotation plate 64 is fast-forwarded by 30 degrees at the high speed. In this case, the fast-forwarding is surely continued until the mark at the other end reaches the display position without performing temporary stop at the timing when a midway mark matches the display position nor performing stop control of the rotation plate 64 following the detection of the fast forwarding stop instruction during the movement in the reversed direction.

Figure 7:
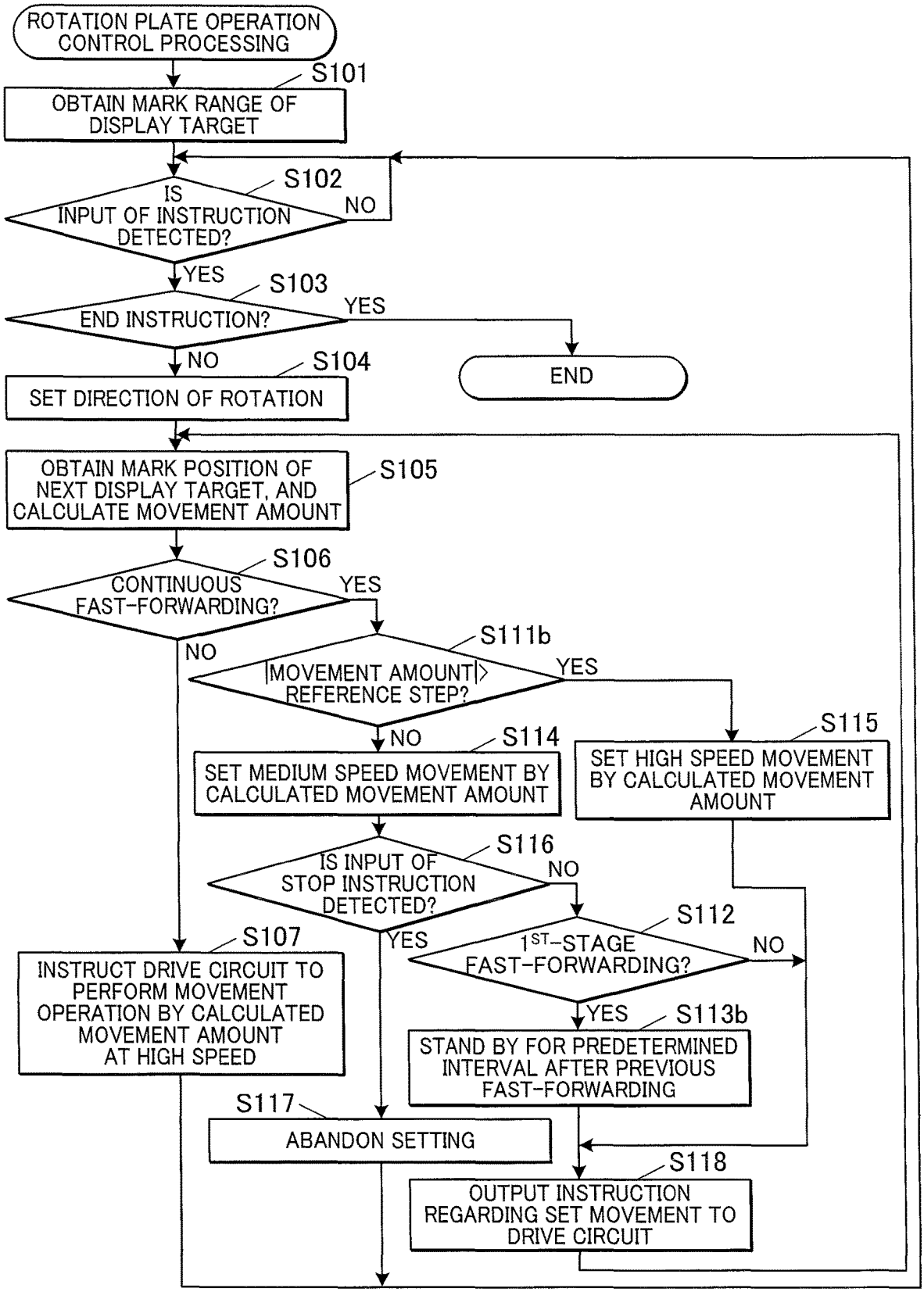
FIG. 7 is a flowchart showing a modification example 2 of the rotation plate operation control processing.

FIG. 7 is a flowchart showing the modification example 2 of the rotation plate operation control processing in the analog electronic timepiece 1 in the embodiment.

In the rotation plate operation control processing in the modification example 2, the processing in steps S111 and S113 are replaced with steps S111*b* and S113*b* respectively in the rotation plate operation control processing shown in FIG. 5 which is performed in the analog electronic timepiece 1 in the above embodiment. The processing in steps S112 and S113*b* is performed after the processing of step S116. The other processing is same, and same reference numerals are provided to same processing contents to omit the detailed explanation.

When the processing proceeds to "YES" in the determination processing of step S106, the CPU 41 determines whether the absolute value of movement amount (|movement amount|) until the mark of the next display target is moved to the display position is larger than the reference number of steps (here, 40 steps; reference amount)(step S111*b*). If it is determined that the absolute value of the movement amount is larger than the reference number of steps (step S111*b*: YES), the CPU 41 performs setting of fast-forward movement by the calculated movement amount at the high speed (step S115). Then, the processing of the CPU 41 shifts to step S118.

If it is not determined that the absolute value is larger than the reference number of steps (if the absolute value is the reference number of steps or less) (step S111*b*: NO), the CPU 41 performs setting of fast-forward movement by the calculated movement amount at the medium speed (step S114). Then, the processing of the CPU 41 shifts to step S116.

In the determination processing of step S116, if it is not determined that the input of stop instruction of continuous fast-forwarding is detected (step S116: NO), the CPU 41 determines whether the continuous fast-forwarding is at the first stage (step S112). If it is determined that the continuous fast-forwarding is at the first stage (step S112: YES), after completion of the fast-forwarding operation according to the movement instruction output in previous step S118, the CPU 41 stops the fast forwarding operation for a predetermined time interval and stands by (step S113*b*). Then, the processing of the CPU 41 shifts to step S118. If it is not determined that the continuous fast-forwarding is at the first stage (step S112: NO), the processing of the CPU 41 shifts to step S118.

In this way, in the rotation plate operation control processing in the modification example 2, a predetermined standby time is inserted each time the fast forwarding is performed for the amount of a single mark and the fast forwarding operation is performed intermittently in the first stage while the rotation speed is equalized to be the medium speed between the first stage and the second stage of the continuous fast forwarding. The standby time does not need to be long as long as the user can visually confirm the display contents and perform the input operation of the stop instruction when the user wishes to stop the fast forwarding.

As described above, the analog electronic timepiece 1 which is an analog display device in the embodiment includes a display 10 which has a rotation plate 64 and changes marks to be displayed (exposed) by rotating the rotation plate 64, a CPU 41 which controls the rotation of the rotation plate 64 and an operation member 47 which receives an input operation by a user. The CPU 41 causes the rotation plate 64 to rotate by fast-forwarding according to a first input operation which is received by the operation member 47 and causes the display 10 to display a plurality of marks in order, stops the fast-forwarding rotation according to a second input operation which is received by the operation member 47. When the CPU 41 causes the rotation plate 64 to perform a fast-forwarding rotation, the CPU 41 determines the fast-forward speed of the rotation plate 64 in at least a part of switching between marks which are adjacent to each other in the order to be displayed to a high speed which is larger than an average movement speed of the rotation plate 64 during a round of display of a plurality of marks by the fast-forwarding rotation.

In this way, the movement speed of the rotation plate 64 is lowered or the movement is temporarily stopped at timings when the mark of display target can match the display position, that is, a desired mark possibly matches the display position. The rotation plate 64 is rotated at a high speed at at least a part of the timings when the mark does not match the display position. Thus, it is possible to allow the user to easily obtain the mark of the rotating rotation plate 64 while suppressing the increase of user's waiting time, and easily and appropriately stop the rotation operation. Accordingly, in the analog electronic timepiece 1, it is possible to improve convenience for the user regarding the change operation of the analog display contents.

If the movement amount of the rotation plate 64 regarding switching between marks which are adjacent to each other in a display order is larger than a predetermined reference amount (40 steps), the fast-forward speed of the rotation plate 64 is determined to a high speed. That is, in a case where the interval of marks which are displayed in order is large or in a case where other marks are sandwiched between the marks, since the movement is performed through these areas at a high speed, it is possible to shorten the time required for movement in the area where the user does not need to visually confirm the marks. On the other hand, in a case where adjacent marks are arranged alongside normally, by setting the speed to a low speed which is lower than the movement speed at the high speed or a medium fast-forward speed, the user can easily visually confirm the marks.

In the fast-forwarding operation, in a case where marks which are not the display target exist in the switching between adjacent display contents which are displayed in order, the CPU 41 determines the fast-forward speed of the rotation plate 64 for switching to a high speed.

By avoiding decrease in the fast-forward speed during passage of the marks which are not the display target in this way, it is possible to make it difficult for the user to easily recognize unnecessary marks. By fast-forwarding the rotation plate 64 at a high speed partially in this way, it is indicated to the user that the rotation plate 64 does not stop at the current rotation angle. Thus, it is possible to prevent the user from watching the marks on the rotation plate 64 than necessary and performing fast-forwarding stop operation at an unnecessary position.

The CPU 41 can cause the rotation plate 64 to rotate at a plurality of fast-forward speeds, and the high speed as the fast-forward speed is the highest speed among the plurality of fast-forward speeds.

In this way, by rotating the rotation plate 64 at the highest speed which can be set for the marks which are not the display target, it is possible to reduce unnecessary time as much as possible while allowing the user to easily see the marks by lowering the speed for the necessary range.

The CPU 41 determines the movement speed for a period when the movement is not performed at the high speed in the fast-forwarding operation to be smaller (that is, fast-forward speed of medium speed or low speed) than the set movement speed of the rotation plate 64 for a case of switching display between two marks which were set in advance.

In this way, also in a case where the destination of the fast-forward movement is already determined and the CPU 41 stops the rotation of the rotation plate 64 at the fast-forwarding destination without requiring user's operation, since the user does not need to visually confirm the midway marks, the fast-forwarding can be performed at a higher speed, that is, for a shorter time compared to a case where the user stops the rotation at a desired rotation position by the input operation while visually confirming marks.

The CPU 41 can cause the rotation plate 64 to perform the rotation operation at a plurality of fast-forward speeds, and the set movement speed is the highest speed among the plurality of fast-forward speeds. That is, by setting the above-mentioned fast-forward speed to the highest speed in the case of not requiring user's operation, it is possible to shorten the fast-forwarding time appropriately.

The movable part of the display 10 includes the rotation plate 64 which is provided so as to be rotatable. As in the rotation operation of the rotation plate 64, when a larger number of operation steps are required for rotation than steps of a normal hand according to the capacity and torque of the drive section such as a stepping motor, the time required for fast-forwarding can be shortened by performing the rotation at a highest speed as possible. However, as a result, in a case of manually stopping the fast-forwarding, the user cannot easily perform the stop operation at or around the exact position. Accordingly, it is possible to improve user's convenience by setting the rotation speed to be large for the angle range where the fast-forward movement is not stopped (there is no mark of the display target) while lowering the rotation speed for the portion where the fast-forward movement is possibly stopped (angle range at and around the rotation position where the mark of the display target matches the display position)

There is provided a dial plate 3 which covers one surface of the rotation plate 64, and a plurality of marks is arranged on the one surface of the rotation plate 64 so as to be exposable from an opening 31 of the dial plate 3 according to the rotation of the rotation plate 64. The opening 31 is formed so that a part of the plurality of marks can be selectively exposed by rotation of the rotation plate 64.

In this way, by exposing only the necessary marks from the opening 31 while providing the plurality of marks on the rotation plate 64, the area exposing unnecessary marks is reduced and the reduced range can be used for a broad and various designs. On the other hand, since only a part of the marks are exposed, when the rotation plate 64 is rotated at a high speed, the user cannot easily visually confirm the exposed marks. Even if the rotation is at a visible speed, there are easily generated problems that the user needs to watch the opening 31 until the desired mark is exposed, and the desired mark passes the display position for the time lag from exposure of the mark to the operation of stopping the fast-forwarding rotation. Accordingly, especially in a case where the fast-forwarding rotation of the rotation plate 64 is stopped on the basis of user's input operation in the analog display device having such a configuration, by determining the fast-forward speed for a period when the fast-forward movement is possibly stopped to be lower than the fast-forward speed in the other cases, it is possible to allow the user to easily and more appropriately stop the fast-forwarding without increasing the time required for the fast-forwarding than necessary.

A plurality of marks is provided in a predetermined rotation angle range with respect to the rotation shaft of the rotation plate 64, and the CPU 41 rotates the rotation plate 64 at a high speed outside the predetermined rotation angle range. That is, in a case where a mark which is the target of selection by the user is not circularly provided over 360 degrees on the rotation plate 64, the fast-forward movement of the rotation plate 64 is not stopped while the range not providing the mark passes the display position. Thus, by performing fast-forwarding at a high speed, it is possible to suppress the increase in fast-forwarding time due to the amount of decrease in the rotation speed so that the user visually confirms the mark of the display target and easily performs the stop operation of the rotation.

On the rotation plate 64, there are provided pluralities of marks respectively corresponding to a predetermined number of (two or more) function operations, here, world clock function, alarm notification function, battery remaining amount display function and selection function of operation function so as to be located in rotation angle ranges different from each other with respect to the rotation shaft of the rotation plate 64. In a case where the rotation plate 64 is rotated for a range outside the rotation angle range where the plurality of marks corresponding to the function operation of the display target is provided according to the first input operation, the CPU 41 rotates the rotation plate 64 at a high speed.

That is, it is possible to arrange marks corresponding to a plurality of function operations on the surface of the rotation plate 64, and expose necessary marks from the opening 31 as needed and hide the other marks in the back side of the dial plate 3. In a case where the rotation plate 64 is fast-forwarded and the user stops the fast-forwarding at a desired position, when marks corresponding to the function operations which are not related to the function under execution pass the display position, the fast-forward movement is performed at a high speed for the range where the marks are provided. Thus, it is possible to reduce the fast-forwarding time required for passage of the range where unnecessary marks are provided while allowing the user to easily visually confirm the marks for the necessary range. Furthermore, by reducing the visibility of unnecessary marks, it is possible to reduce the trouble of watching the marks exposed from the opening 31 for the unnecessary range and searching for the desired mark.

The CPU 41 temporarily stops the rotation plate 64 for a predetermined period for each mark display in the fast-forwarding operation of the rotation plate 64.

Thus, the user can visually confirm the mark of the selection target more surely and perform the input operation of stopping the fast-forward movement at an appropriate timing. The fast-forwarding is not temporarily stopped at timings when a mark which is not the selection target matches the display position. Thus, the user does not need to pay attention to the mark exposed from the opening 31 during the fast-forwarding, and the fast-forwarding is not stopped by mistake at the timings when a mark which is not the selection target is located at the display position.

The analog electronic timepiece 1 in the embodiment includes a time counting circuit 46 which counts current time in addition to the above-mentioned configuration. The display 10 can display time corresponding to the current time counted by the time counting circuit 46 by control of the CPU 41 by further including the time hands 61 to 63.

By applying the present invention to the fast-forwarding operation of the rotation plate 64 included in such an analog electronic timepiece 1 and adjusting the fast-forward speed for each rotation angle range, it is possible to prevent the time required for rotation of the rotation plate 64 from being lengthened than necessary, and allow the user to recognize the position of desired mark and easily stop the mark at the display position. Especially, since the present invention avoids exposure of many marks than necessary and uniform setting of rotation speed of the rotation plate 64 to a low speed in a compact portable electronic timepiece such as a wristwatch, the width of design of the electronic timepiece is broadened and both of the operability and design property are achieved.

By using the above-mentioned display operation control method of the rotation plate 64, the time required for fast-forwarding is not increased than necessary while easily and appropriately enabling the stop instruction of fast-forwarding operation on the basis of user's operation in analog display. Thus, it is possible to improve user's convenience.

Since the program 421 regarding control of rotation plate operation control processing is stored in the ROM 42 and executed by the CPU 41, it is possible to control the rotation operation of the rotation plate 64 based on user's operation easily and flexibly without requiring modification or the like of the hardware configuration and improve user's convenience.

The present invention is not limited to the above embodiment, and various changes can be made.

For example, in the embodiment, the rotation speed for the angle range outside the display target is the highest speed which can be set. However, the present invention is not limited to this. The rotation speed may be set to be slightly decreased in a case where continuous movement at the highest speed in continuous fast-forwarding is difficult due to the problem of power supply or the like, for example.

In the modification example 2 of the embodiment, the operation of the rotation plate 64 is temporarily stopped at the mark position which is the display target in a case of the first stage fast-forwarding. In this case, the fast-speed movement may be performed at a same speed without differentiating the fast-forward speed between the angle range of the display target and the other range. That is, the second stage fast-forwarding may be same as the fast-forwarding outside the angle range. Or, there may be no second stage fast-forwarding, and there may be only the two types of the first stage fast-forwarding and the continuous fast-forwarding outside the display target angle range.

In the embodiment, the rotation plate 64 has a disk shape, and marks regarding a plurality of function types are provided in angle ranges which are different from each other. However, the present invention is not limited to this.

Figure 8:
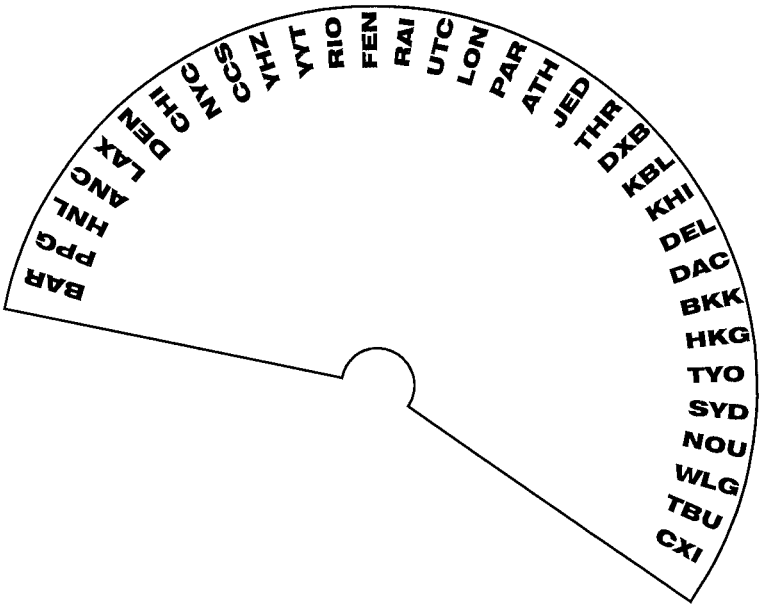
FIG. 8 is a front view showing a modification example of the rotation plate.

FIG. 8 is a front view showing a modification example of the rotation plate 64.

In this way, the rotation plate 64 may be in a fan shape or other shapes. There may be provided only the plurality of marks corresponding to a single specific function type. Also in this case, the present invention can be applied in fast-forwarding between both of the ends in the angle range where the marks are provided.

In this case, the rotation plate 64 does not need to be rotatable by 360 degrees, and may be capable of the rotation operation only in a part of rotation angle range. In this case, the fast-forwarding between marks on the both ends is performed by backward rotation.

In the embodiment, the rotation plate 64 having marks is rotated and the marks are exposed from the fixed opening. However, with respect to a fixed plate having marks, a rotation plate having an opening may be rotated to switch the marks to be exposed. Instead of rotation plate, an endless band may be rotated by a roller or the like. The electronic timepiece is not limited to the timepiece provided with a shielding plate which covers the marks other than the marks of the display target. The rotation plate is not limited to a flat plane type provided with marks. The present invention can also be similarly applied even to hands type especially when the rotation angle per 1 step is small, the number of steps requiring rotation is large and the high speed movement can be performed.

In the embodiment, the rotation speed is increased in a case where the interval between marks of display target is partially larger than the reference amount. However, even in a case where the marks are arranged at a uniform interval, when each interval is large due to small number of marks or the like, high speed rotation may be performed by setting not to decrease the rotation speed temporarily at a part of the intervals, the midway part or the like.

In the embodiment, the fast-forward speed is uniformly suppressed in the angle range of the display target than in the range outside the angle range. However, in a case where the number of steps between marks is large, the fast-forward speed may be increased at a partial region such as around the center between the marks.

The embodiment has been described by taking, as an example, the fast-forwarding operation of the rotation plate 64 in setting of city (local time) of the world clock and selection of a function mode to be executed in the electronic timepiece. However, the present invention is not limited to this. In a case of manually selecting the display contents during fast-forwarding and stopping the rotation in various analog display devices (for example, a meter which measures and displays various physical quantity) each of which has a display that uses a movable display, electrically controls the operation of the movable section and switches the display contents in an analog manner, the fast-forward speed in the range where the fast-forwarding is possibly stopped is suppressed compared to the part which is in the midway of switching between display contents and the fast-forwarding is not stopped. Thereby, the user can surely recognize the marks, and easily and appropriately stop the fast-forwarding.

In the embodiment, the CPU 41 (microcomputer) controls the rotation operation of the rotation plate 64 by software by executing the rotation plate operation control processing and outputting a control signal to the drive circuit 51. However, a part of the control operation or the like may be performed by a dedicated hardware circuit in the drive circuit 51.

The embodiments have been described by taking, as an example, the ROM 42 which can include a nonvolatile memory as a computer readable medium of the program 421 of operation processing such as the rotation plate operation control processing regarding the processing operation of the CPU 41 according to the present invention. However, the present invention is not limited to this. As other computer readable media, an HDD (Hard Disk Drive), a portable storage medium such as a CD-ROM and a DVD disk can be applied. Also, as a medium providing program data according to the present invention via a communication line, carrier wave can also be applied to the present invention.

The other specific details such as configurations, control contents and procedures shown in the embodiments can be appropriately changed within the scope of the present invention.

Though several embodiments of the present invention have been described above, the scope of the present invention is not limited to the above embodiments, and includes the scope of inventions, which is described in the scope of claims, and the scope equivalent thereof.

The entire disclosure of Japanese Patent Application No. 2016-215181 filed on Nov. 2, 2016 including description, claims, drawings, and abstract are incorporated herein by reference in its entirety.

What is claimed is:

1. An analog display device, comprising:

a display which includes a movable display;

a processor which controls a movement operation of the movable display; and an operation member which receives an input operation by a user, wherein the display changes a display content by the movable display performing the movement operation, the processor causes the movable display to begin to move, to perform a fast-forward movement operation and display a plurality of display contents by the display in order in accordance with a first input operation which is received by the operation member, the processor stops the fast-forward movement operation in accordance with a second input operation which is received by the operation member, and while further input operation by the operation member is not performed after the first input operation is received and before the second input operation is received, the processor changes a fast-forward movement speed of the movable display in at least a part of switching between display contents which are adjacent to each other in an order of display to a high movement speed which is larger than an average movement speed of the movable display during a round of display of the plurality of display contents by the fast-forward movement operation.

2. The analog display device according to claim 1, wherein, when a movement amount of the movable display for the switching between the adjacent display contents is larger than a predetermined reference amount, the processor determines the fast-forward movement speed of the movable display to the high movement speed.

3. The analog display device according to claim 2, wherein, when the processor causes the movable display to perform the fast-forward movement operation, in a case where switching between adjacent display contents which are displayed in order includes a state in which a display content that is not a target of display is displayed, the processor determines the fast-forward movement speed of the movable display for the switching to the high movement speed.

4. The analog display device according to claim 3, wherein the processor is capable of causing the movable display to perform the movement operation at a plurality of fast-forward movement speeds, and the high movement speed is a highest speed among the plurality of fast-forward movement speeds.

5. The analog display device according to claim 2, wherein the processor is capable of causing the movable display to perform the movement operation at a plurality of fast-forward movement speeds, and the high movement speed is a highest speed among the plurality of fast-forward movement speeds.

6. The analog display device according to claim 2, wherein the processor determines a movement speed for a period when the processor does not cause the movable display to move at the high movement speed in the fast-forward movement operation to be smaller than a set movement speed of the movable display which is a speed when the processor causes the display to perform a switching operation of display between two preset display contents.

7. The analog display device according to claim 1, wherein, when the processor causes the movable display to perform the fast-forward movement operation, in a case where switching between adjacent display contents which are displayed in order includes a state in which a display content that is not a target of display is displayed, the processor determines the fast-forward movement speed of the movable display for the switching to the high movement speed.

8. The analog display device according to claim 7, wherein the processor is capable of causing the movable display to perform the movement operation at a plurality of fast-forward movement speeds, and the high movement speed is a highest speed among the plurality of fast-forward movement speeds.

9. The analog display device according to claim 7, wherein the processor determines a movement speed for a period when the processor does not cause the movable display to move at the high movement speed in the fast-forward movement operation to be smaller than a set movement speed of the movable display which is a speed when the processor causes the display to perform a switching operation of display between two preset display contents.

10. The analog display device according to claim 1, wherein the processor is capable of causing the movable display to perform the movement operation at a plurality of fast-forward movement speeds, and the high movement speed is a highest speed among the plurality of fast-forward movement speeds.

11. The analog display device according to claim 1, wherein the processor determines a movement speed for a period when the processor does not cause the movable display to move at the high movement speed in the fast-forward movement operation to be smaller than a set movement speed of the movable display which is a speed when the processor causes the display to perform a switching operation of display between two preset display contents.

12. The analog display device according to claim 11, wherein the processor is capable of causing the movable display to perform the movement operation at a plurality of fast-forward movement speeds, and the set movement speed is a highest speed among the plurality of fast-forward movement speeds.

13. The analog display device according to claim 1, wherein the movable display includes a display plate which is provided so as to be rotatable.

14. The analog display device according to claim 13, further comprising a shielding plate which covers one surface of the display plate, wherein a plurality of marks is provided on the one surface so as to be exposable from an opening of the shielding plate in accordance with a rotation of the display plate, and the opening is formed so as to be capable of selectively exposing a part of the plurality of marks by the rotation of the display plate.

15. The analog display device according to claim 14, wherein the plurality of marks is provided in a predetermined rotation angle range with respect to a rotation shaft of the display plate, and the processor causes the display plate to perform a rotation operation at the high movement speed for a range outside the predetermined rotation angle range.

16. The analog display device according to claim 14, wherein on the display plate, pluralities of marks corresponding to a predetermined number of respective function operations are provided in rotation angle ranges which are different from each other with respect to a rotation shaft of the display plate, the predetermined number being two or more, and the processor causes the display plate to perform the rotation operation at the high movement speed when, in accordance with the first input operation, the processor causes the display plate to perform the rotation for a range outside a rotation angle range where a plurality of marks corresponding to a function operation which is a target of display is provided.

17. The analog display device according to claim 1, wherein the processor temporarily stops the movable display for a predetermined period for each display of the display content in the fast-forward movement operation of the movable display.

18. An electronic timepiece, comprising:

the analog display device according to claim 1; and a time counter which counts current time, wherein the display is capable of displaying time corresponding to the current time counted by the time counter by control of the processor.

19. A display operation control method of an analog display device that includes: a display which includes a movable display and changes a display content by the movable display performing a movement operation; and an operation member which receives an input operation by a user, the method comprising:

a fast-forwarding control step of causing the movable display to begin to move, to perform a fast-forward movement operation and display a plurality of display contents by the display in order in accordance with a first input operation which is received by the operation member; and a fast-forwarding stop step of stopping the fast-forward movement operation in accordance with a second input operation which is received by the operation member, wherein in the fast-forwarding control step, while further input operation by the operation member is not performed after the first input operation is received and before the second input operation is received, a fast-forward movement speed of the movable display in at least a part of switching between display contents which are adjacent to each other in an order of display is changed to a high movement speed which is larger than an average movement speed of the movable display during a round of display of the plurality of display contents by the fast-forward movement operation.

20. A non-transitory storage medium storing a program which is readable by a computer of an analog display device that includes: a display which includes a movable display and changes a display content by the movable display performing a movement operation; and an operation member which receives an input operation by a user, the program causing the computer to function as:

a fast-forwarding control section which causes the movable display to begin to move, to perform a fast-forward movement operation and display a plurality of display contents by the display in order in accordance with a first input operation which is received by the operation member; and a fast-forwarding stop section which stops the fast-forward movement operation in accordance with a second input operation which is received by the operation member, wherein the fast-forwarding control section, while further input operation by the operation member is not performed after the first input operation is received and before the second input operation is received, changes a fast-forward movement speed of the movable display in at least a part of switching between display contents which are adjacent to each other in an order of display to a high movement speed which is larger than an average movement speed of the movable display during a round of display of the plurality of display contents by the fast-forward movement operation.

* * * * *